US007517262B2

(12) United States Patent
Mizutani

(10) Patent No.: US 7,517,262 B2
(45) Date of Patent: Apr. 14, 2009

(54) STEERING SYSTEM FOR OUTBOARD MOTOR

(75) Inventor: Makoto Mizutani, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/781,785

(22) Filed: Jul. 23, 2007

(65) Prior Publication Data

US 2008/0200080 A1 Aug. 21, 2008

(30) Foreign Application Priority Data

Jul. 26, 2006 (JP) ..... 2006-203815
Dec. 13, 2006 (JP) ..... 2006-335558

(51) Int. Cl.
*B63H 5/125* (2006.01)
*B63H 20/08* (2006.01)
*B63H 5/20* (2006.01)

(52) U.S. Cl. ..... 440/59; 440/58; 440/53

(58) Field of Classification Search ..... 440/49, 440/53, 55, 58–60
See application file for complete search history.

(56) References Cited

U.S. PATENT DOCUMENTS 6,843,195 B2 * 1/2005 Watabe et al. ..... 114/144 E
7,267,587 B2 * 9/2007 Oguma et al. ..... 440/58

FOREIGN PATENT DOCUMENTS

JP 04-038297 2/1992
JP 2959044 7/1999
JP 2005-254848 9/2005
JP 2006-069408 3/2006

OTHER PUBLICATIONS

U.S. Appl. No. 11/859,544, filed Sep. 21, 2007, entitled Watercraft Steering System.
U.S. Appl. No. 11/859,654, filed Sep. 21, 2007, entitled Watercraft Steering System.
U.S. Appl. No. 11/859,533, filed Sep. 21, 2007, entitled Watercraft Steering System.
U.S. Appl. No. 11/853,731, filed Sep. 11, 2007, entitled Boat Steering System.

* cited by examiner

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

A swivel bracket of an outboard motor pivots about an axis of a tilt shaft disposed at a front end of the bracket unit and extending horizontally in a vertical plane to adjust a tilt angle and a trim angle of the outboard motor. A steering system for the outboard motor includes a pivotal gear attached to the swivel shaft, a drive mechanism driving the pivotal gear, and an electric motor providing drive force to the drive mechanism. Preferably these steering system components are positioned between the swivel bracket and an engine cowling of the outboard motor.

6 Claims, 9 Drawing Sheets

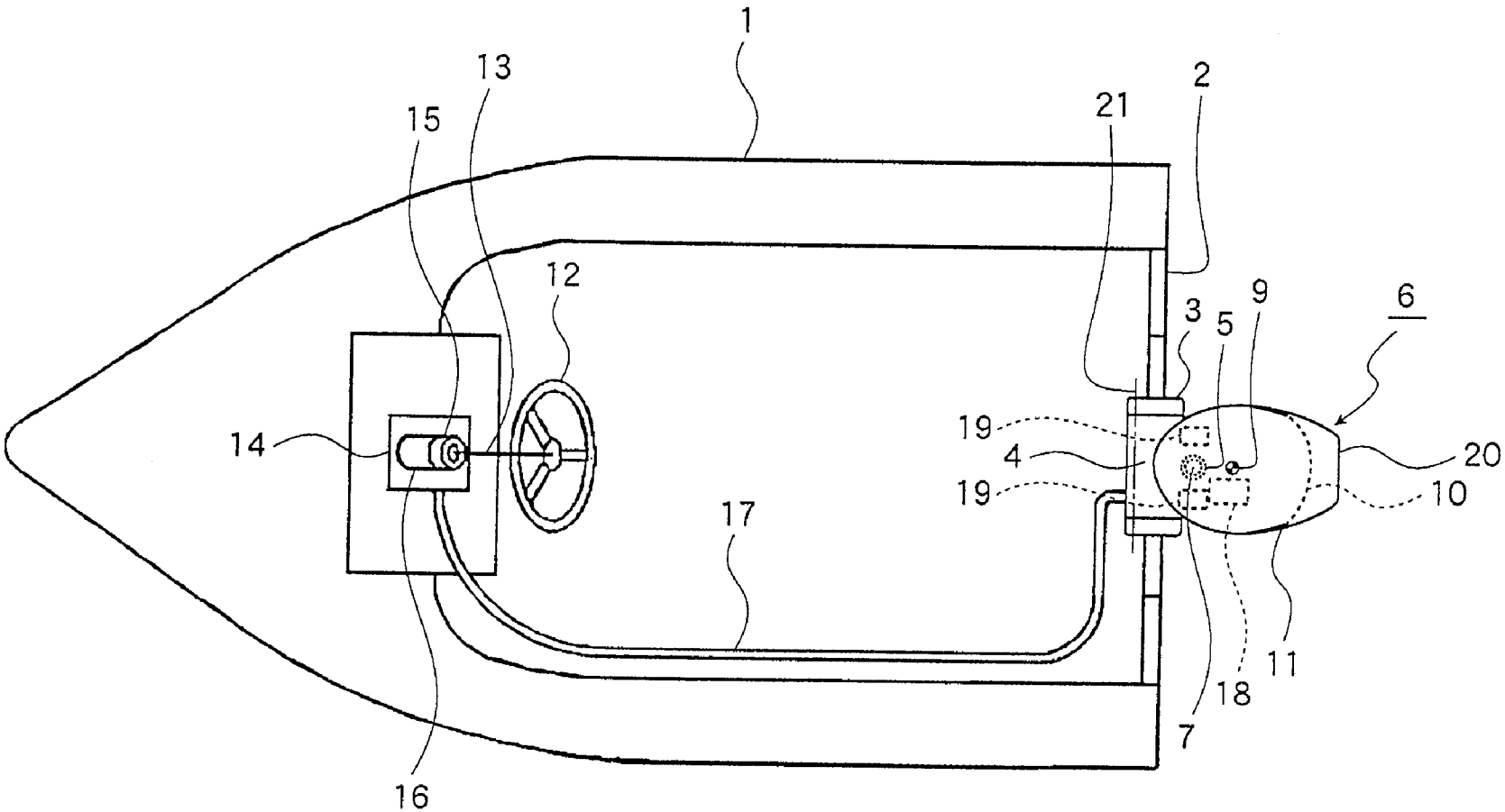
[FIG. 1]

[FIG. 2]
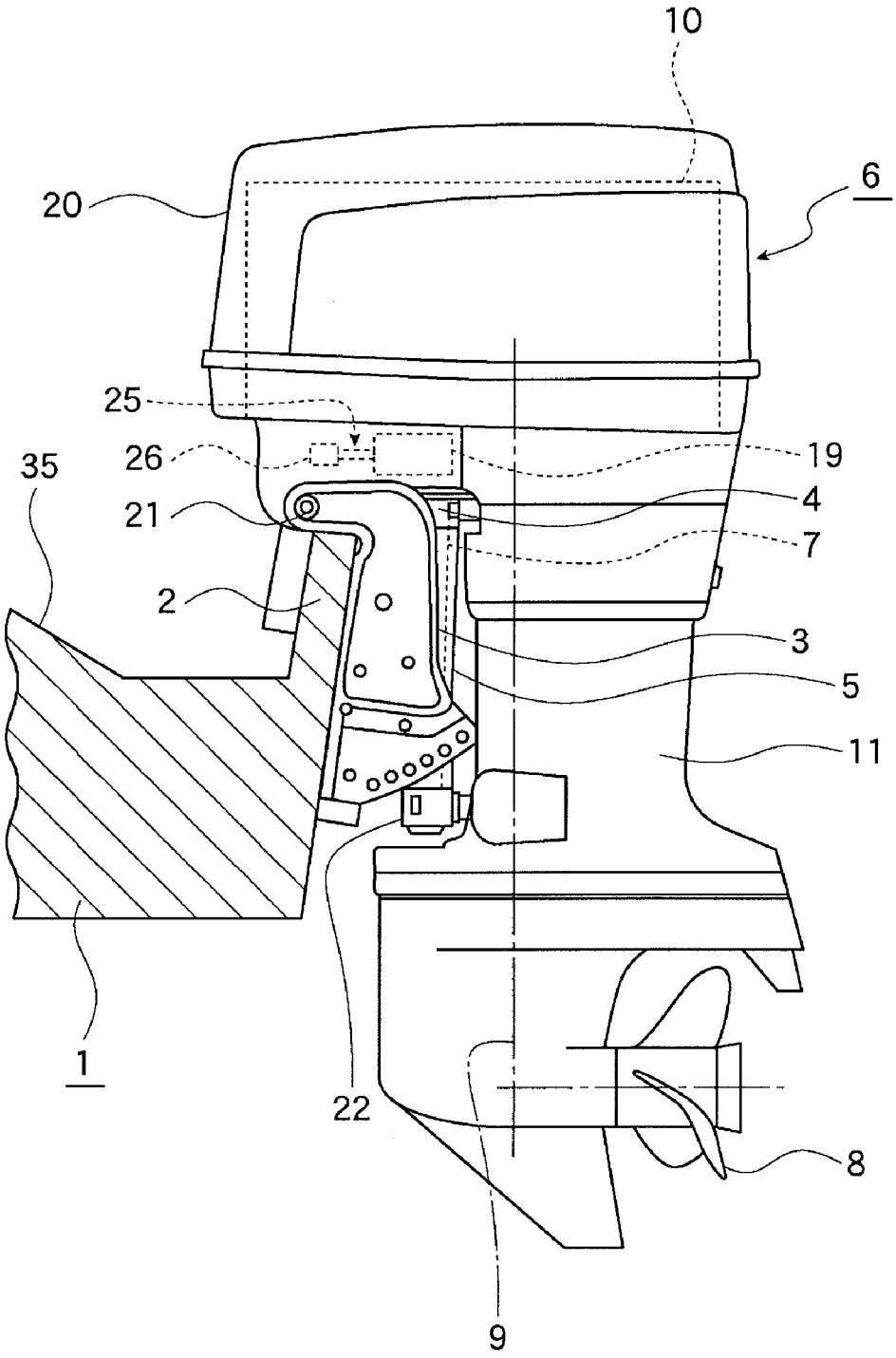

[FIG. 3]
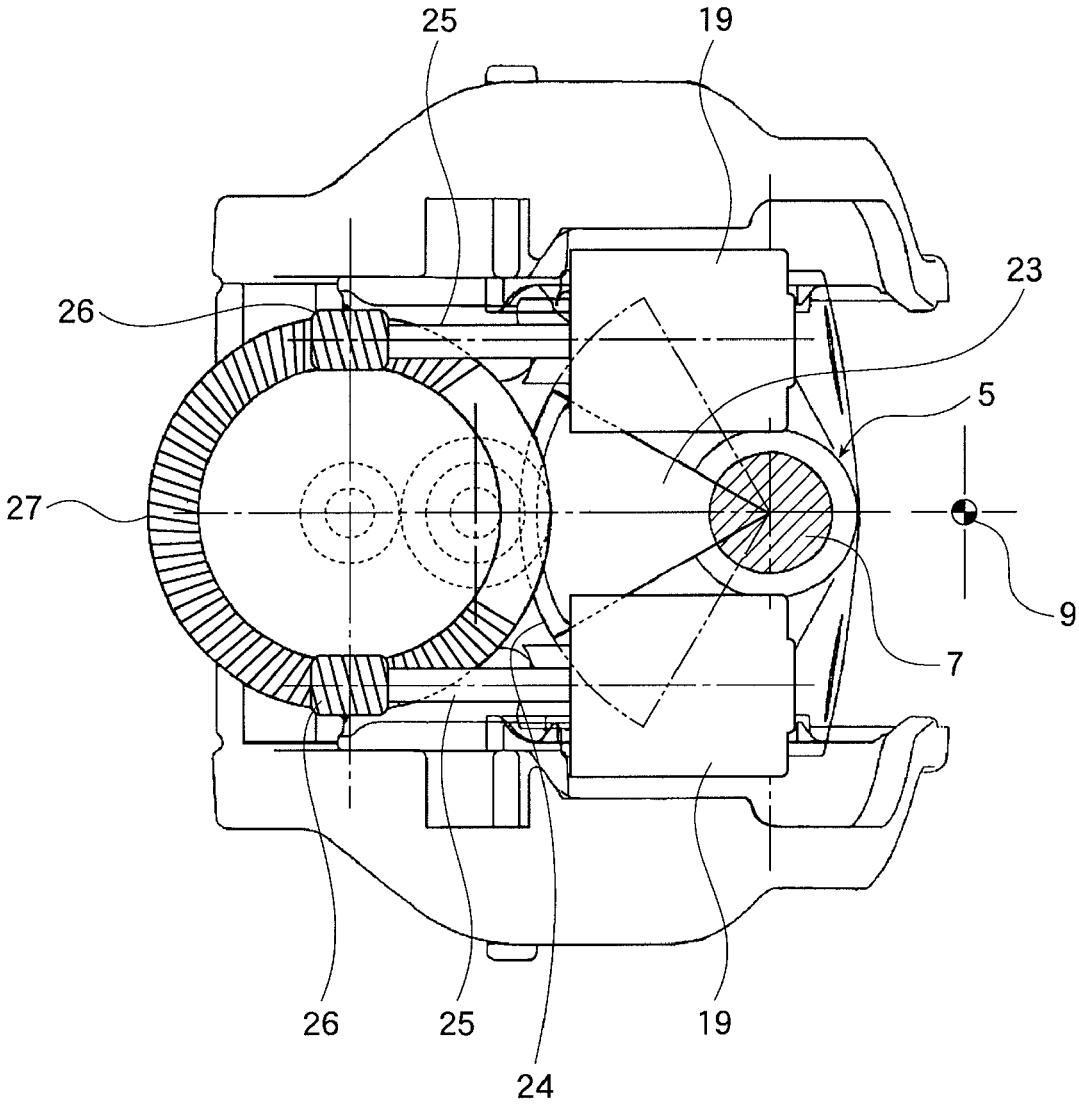

[FIG. 4]
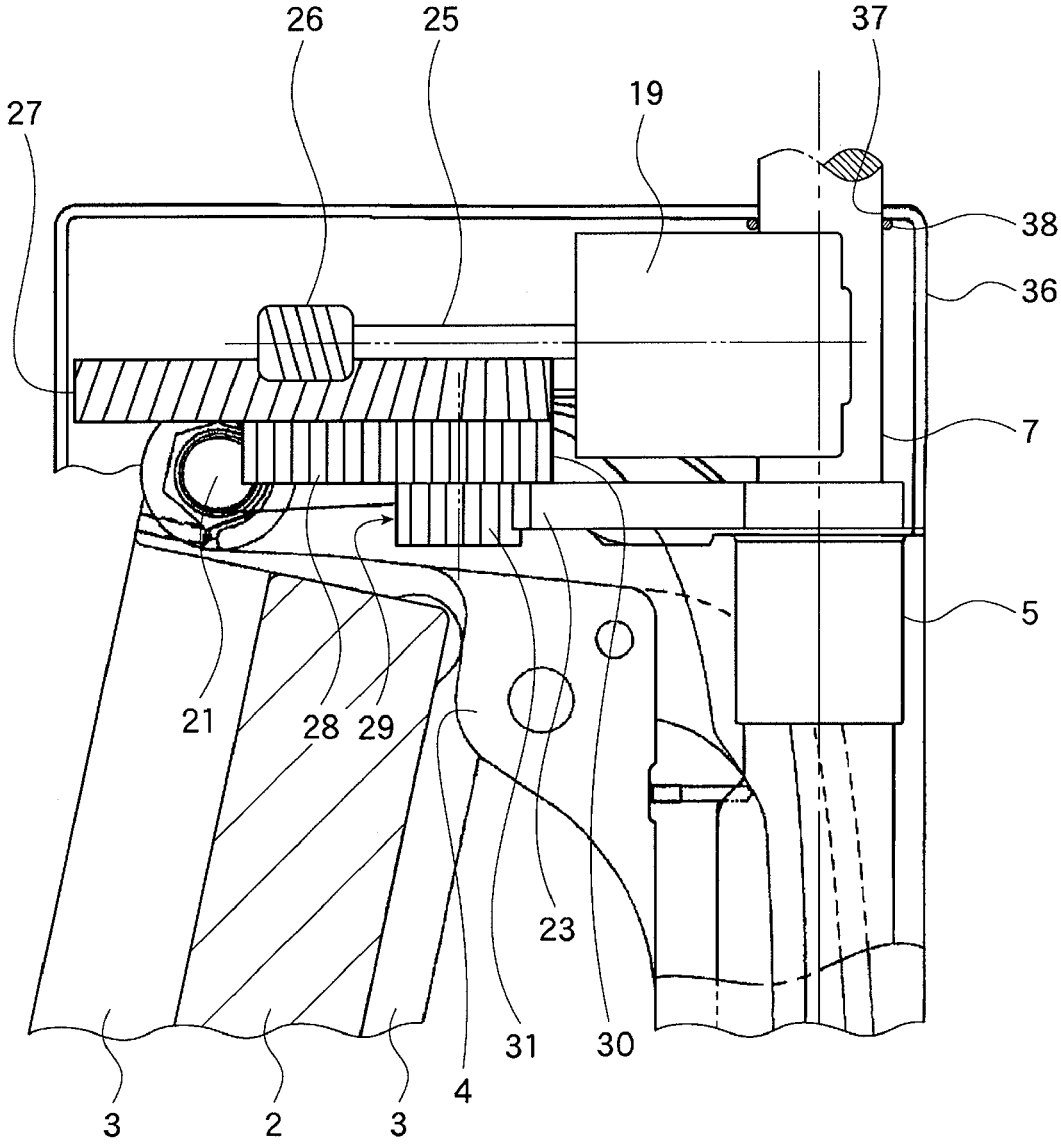

[FIG. 5]
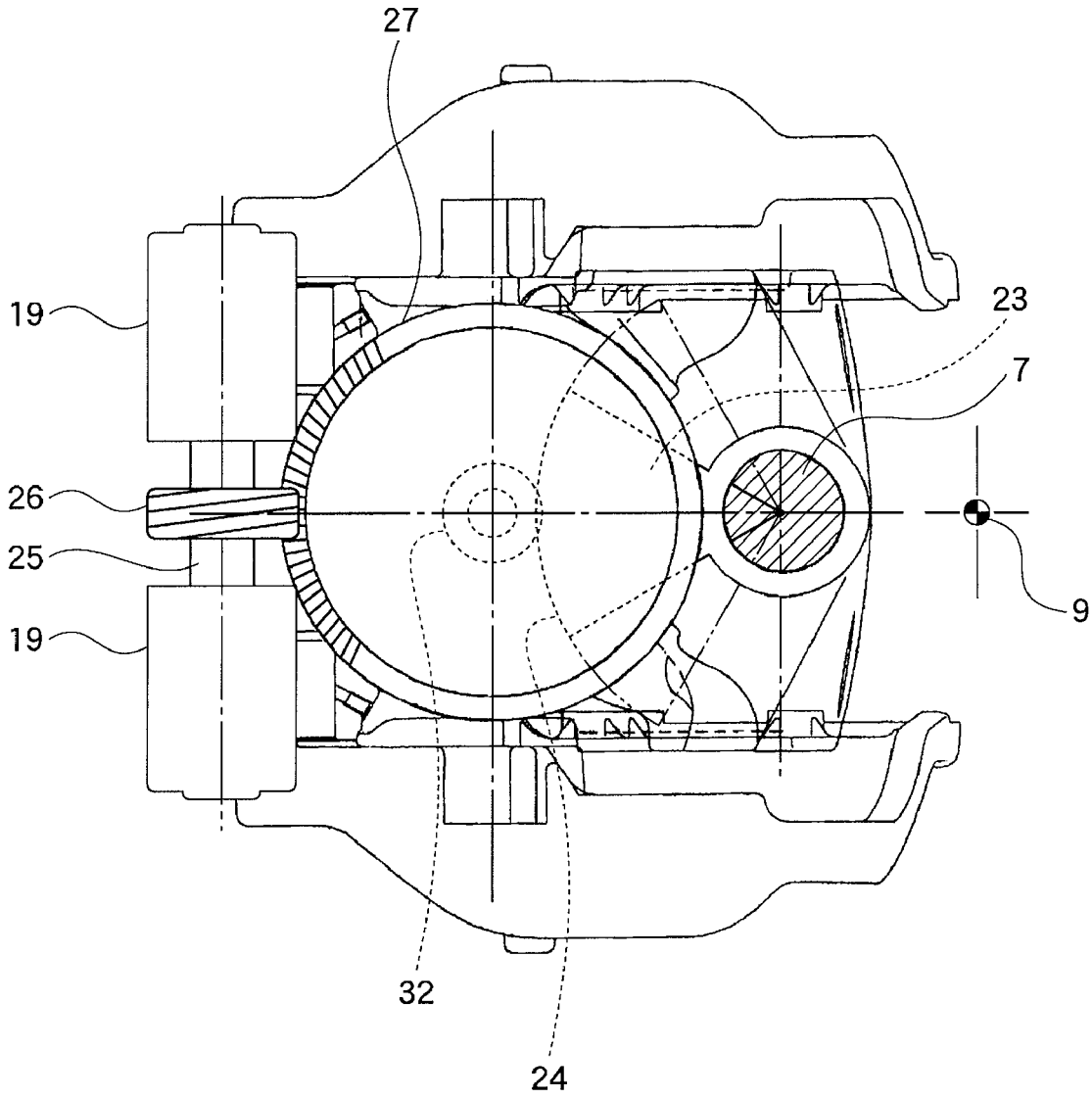

[FIG. 6]
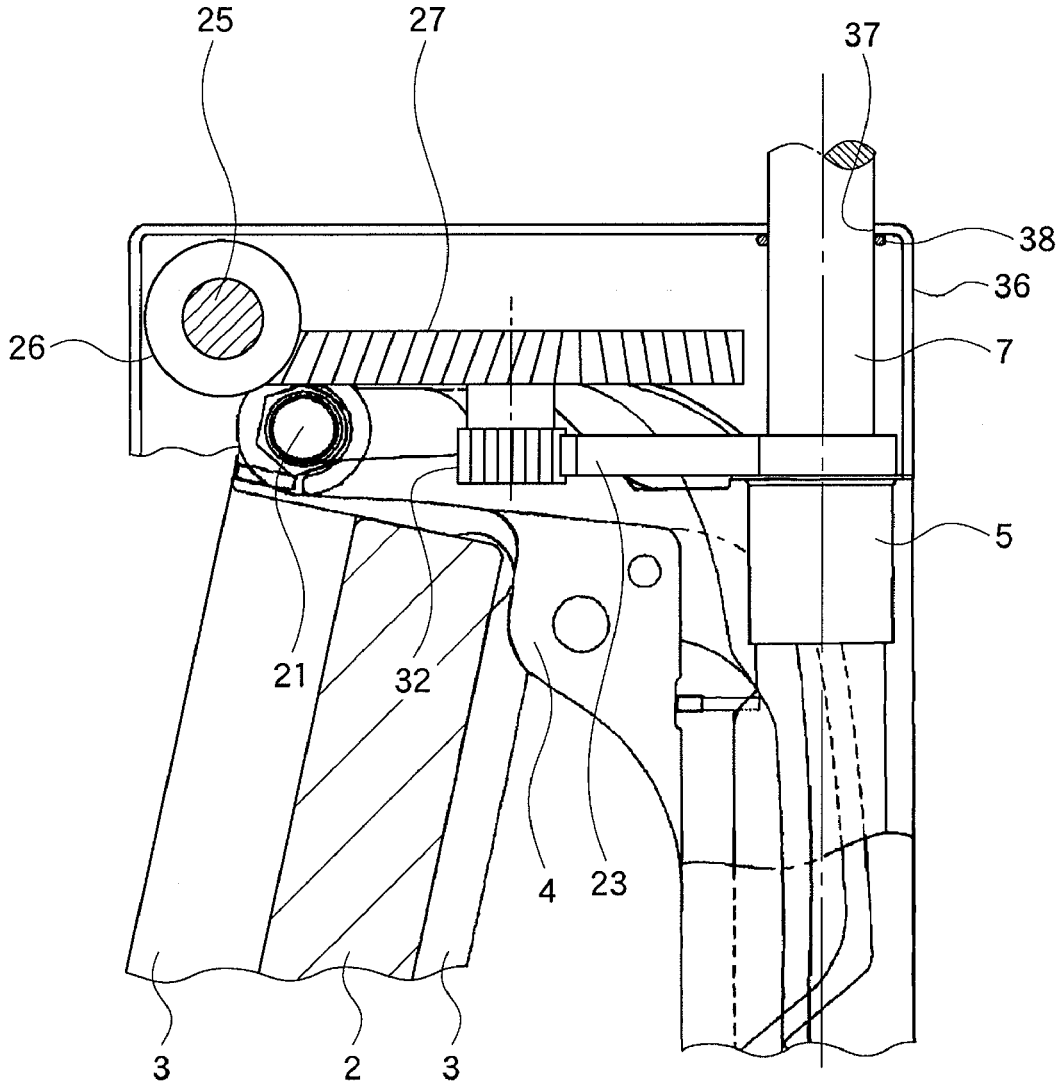

[FIG. 7]
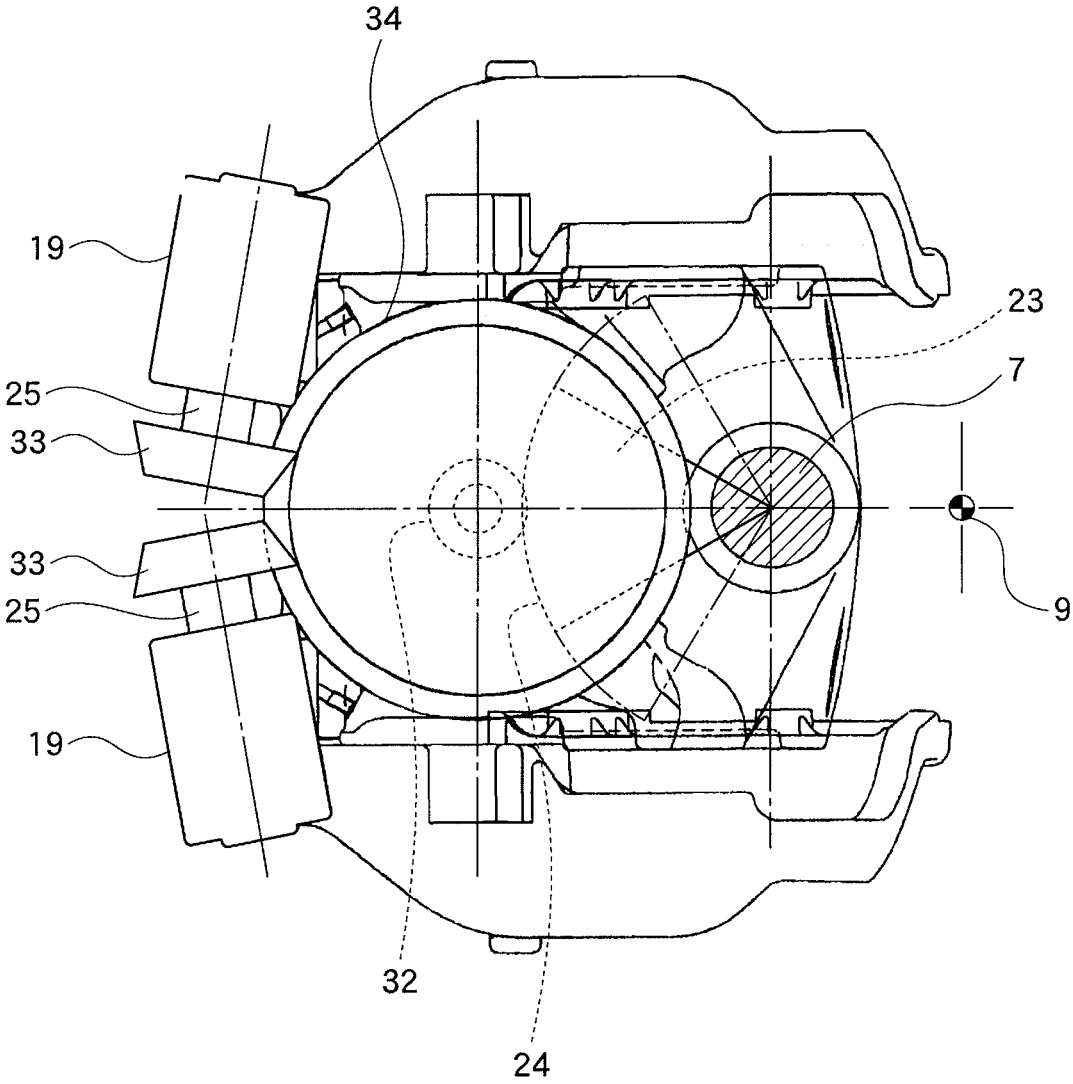

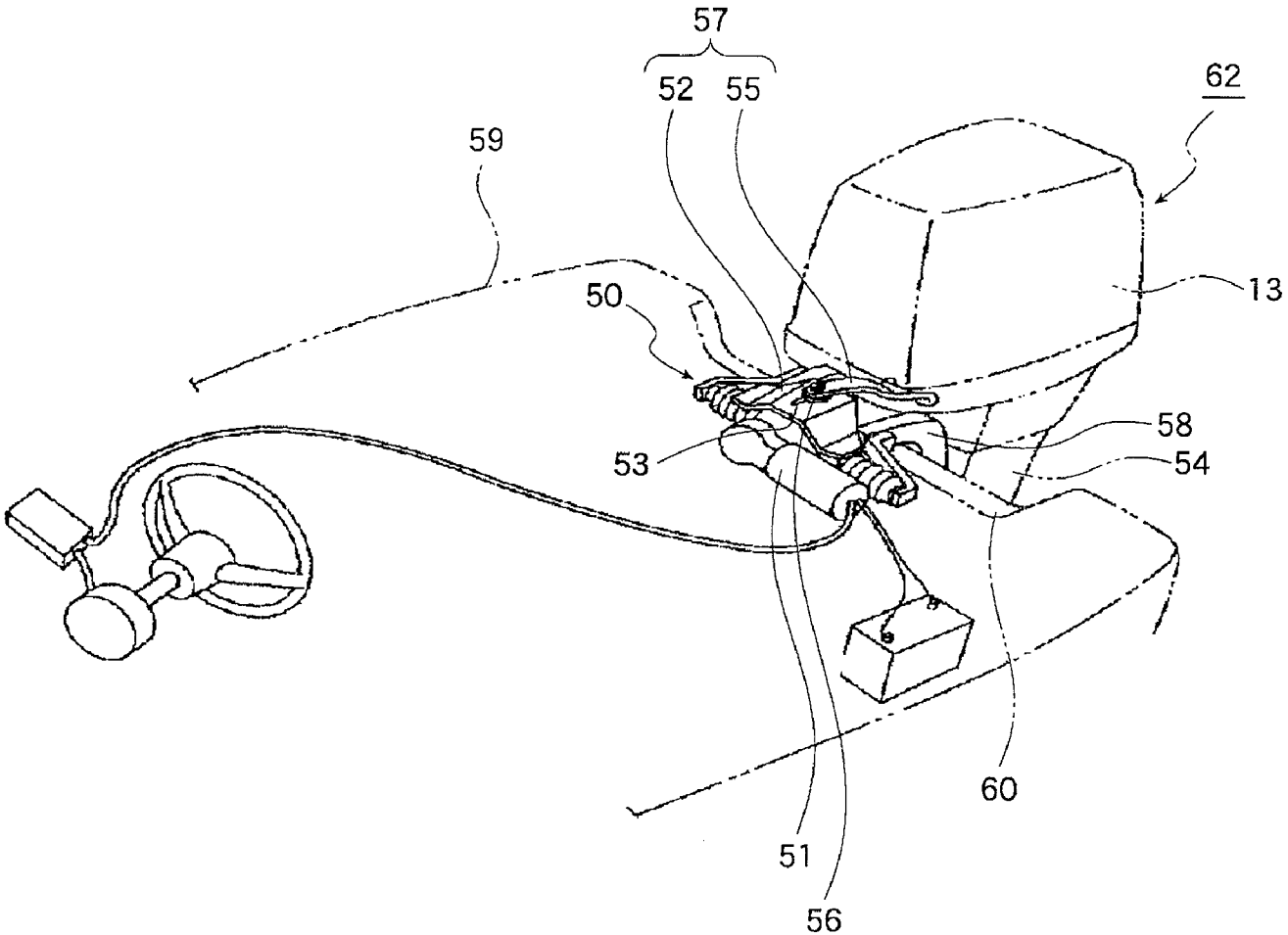
[FIG. 8]
Prior Art

[FIG. 9]
Prior Art
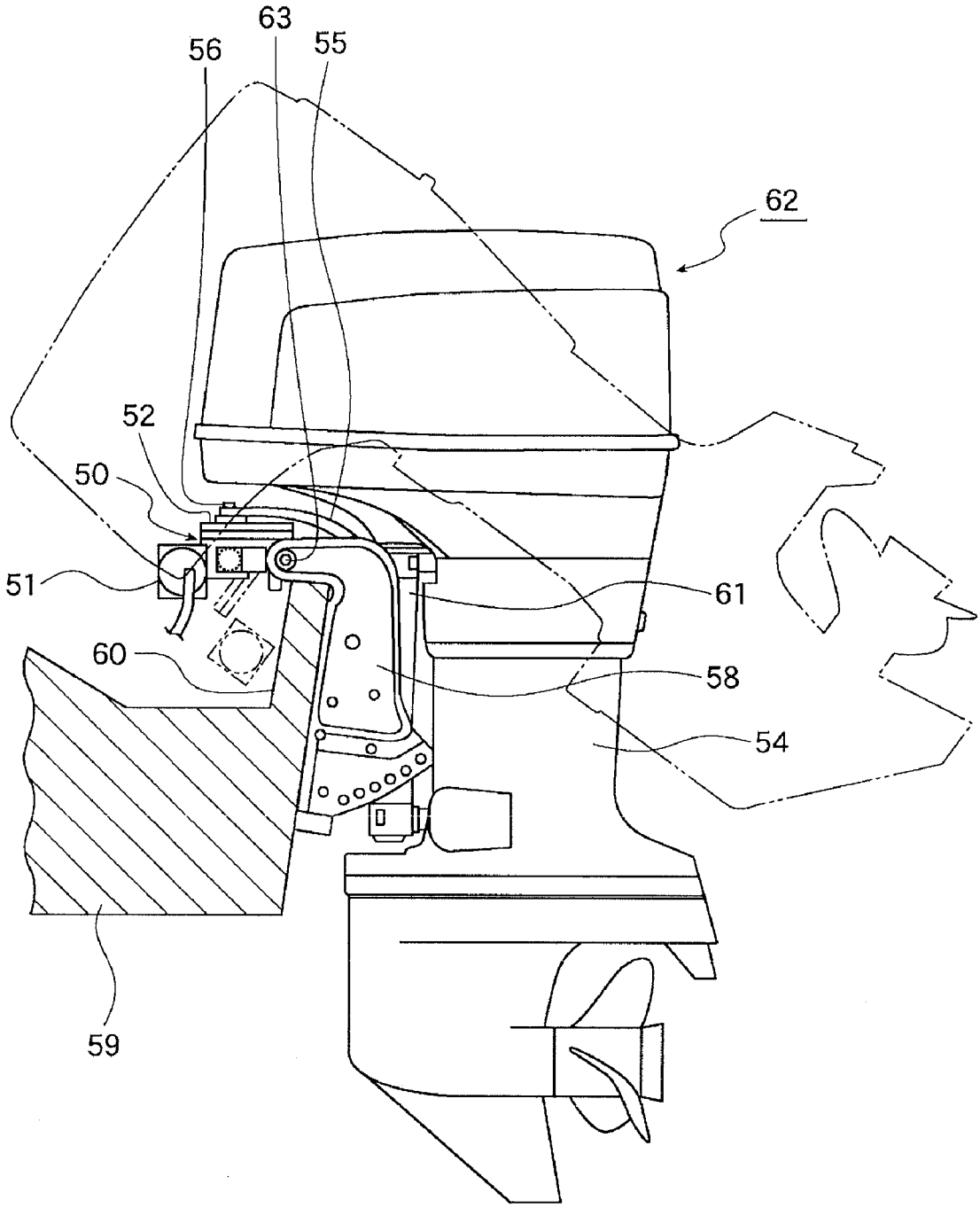

STEERING SYSTEM FOR OUTBOARD MOTOR

CROSS-REFERENCE TO RELATED APPLICATIONS

The present application is based on and claims priority under 35 U.S.C. § 119 to Japanese Patent Application Ser. No. 2006-203815, filed on Jul. 26, 2006, and Japanese Patent Application Serial No. 2006-335558, filed on Dec. 13, 2006. The entire contents of these priority applications are expressly incorporated by reference herein.

BACKGROUND OF THE INVENTION

1. Field of the Invention

The present invention relates to a steering system for an outboard motor, the steering system generating steering force by an electric motor.

2. Description of the Related Art

Small watercraft fitted with outboard motors typically include a steering wheel to provide steering input for the motor. A steering system can translate steering wheel inputs into movement of the motor for steering the watercraft.

As shown in FIGS. 8 and 9, one conventional steering system employs a drive mechanism 50 formed with a rack and pinion unit, each with an electric motor, for an outboard motor (see also Japanese Publication No. 04-038297). An electric motor 51 is used as a driving power source generating rotational power of a pinion of the unit. A guide plate 52 moving linearly in a transverse direction together with the pinion has a slot 53 extending in a fore to aft direction. A guide pin 56 is disposed at an end of a steering bracket 55 fixed to an outboard motor body 54 and extending horizontally. A link mechanism 57 is formed with the guide plate 52 and the guide pin 56 in such a manner that the guide pin 56 is slidably fitted into the slot 53 of the guide plate 52. The pinion moves over a rack of the unit to convert the linear movement of the pinion to the pivotal movement of the steering bracket 55 via the link mechanism 57. The pivotal movement of the steering bracket 55 steers the outboard motor body 54.

The conventional steering system for an outboard motor is arranged so that: a clamping bracket 58 mounts the outboard motor body 54 to a transom board 60 of the watercraft 59. The outboard motor body 54 is allowed to pivot rightward or leftward in a horizontal plane about an axis of a swivel shaft (not shown) pivotally carried by a swivel bracket 61 fixed to the outboard motor body 54. Thereby, a forward direction of the watercraft 59 is decided.

However, in such a conventional steering system for an outboard motor, the drive mechanism 50 including the electric motor 51 and the rack and pinion unit is attached to the watercraft at a location adjacent to a tilt shaft 63 positioned in front of the clamping bracket 58 that couples the outboard motor 62 to the transom board 60. The drive mechanism 50 is positioned generally inside of the watercraft 59, and room adjacent the transom 60 is needed to accommodate this mechanism. Also, the clamping bracket 58 needs an aperture for attachment. Furthermore, the outboard must carry the steering bracket 55. Such a construction makes the whole structure complicated and also makes the combined clamping bracket 58 and drive mechanism 50 voluminous. Also, attaching the steering system thus may prove to be troublesome. In addition, the steering system can occupy a large space around the clamping bracket 58 within the watercraft 59 to prevent the system from interfering with other components when the outboard motor body 54 is tilted up.

SUMMARY

Accordingly, there is a need in the art for a construction around a tilt shaft of a clamping bracket within a watercraft that is relatively simple, that can simplify and facilitate attaching the steering system, and that can extend a space around the clamping bracket for a tilt up movement of an outboard motor body.

In accordance with one embodiment, the present invention provides a watercraft comprising a transom having an outboard motor mounted thereon through a mount unit having a swivel member and a clamping member. The outboard motor has a cowling and is supported by the swivel member in a manner so that the outboard motor may pivot about a generally vertical axis in a generally horizontal plane. The swivel member is attached to the clamping member at a tilt member disposed in a forward portion of the clamping member and is configured so that the swivel member pivots about an axis of the tilt member in a generally vertical plane to adjust a tilt angle and a trim angle of the outboard motor. A steering mechanism comprises a pivotal gear adapted to pivot with the outboard motor, a drive mechanism for driving the pivotal gear, and an electric motor adapted to provide drive force for the drive mechanism. The pivotal gear, drive mechanism and electric motor are disposed between the tilt member and the outboard motor cowling.

In one embodiment, the drive mechanism includes a worm gear attached to an output shaft of the electric motor and a worm wheel meshing with the worm gear, and the drive mechanism is positioned between a center and a front end of the swivel bracket. In some embodiments, the worm gear is an hourglass worm gear, and the worm wheel is an hourglass worm wheel. In some other embodiments, the worm gear and the worm are hypoids types.

In another embodiment, the drive mechanism includes a small bevel gear attached to an output shaft of the electric motor and a large bevel gear meshing with the small bevel gear, and the drive mechanism is positioned between a center and a rear end of the swivel bracket. In some embodiments, the small bevel gear and the large bevel gear are hypoid types.

In accordance with another embodiment, the present invention provides an outboard motor adapted to be mounted to a transom board of a watercraft through a bracket unit having a swivel bracket and a clamping bracket. The outboard motor has a steering system comprising a swivel shaft disposed in a rear portion of the bracket unit and extending generally vertically, and a pivoting mechanism for pivoting the outboard motor about an axis of the swivel shaft in a generally horizontal plane. The swivel bracket of the outboard motor is adapted to pivot in a generally vertical plane about a generally horizontal axis of a tilt member disposed in a front portion of the bracket unit so as to adjust a tilt angle and a trim angle of the outboard motor. A pivotal gear is attached to the swivel shaft. A drive mechanism drives the pivotal gear. An electric motor provides drive force to the drive mechanism. The pivotal gear, drive mechanism and electric motor are positioned between the swivel bracket and an engine cowling of the outboard motor.

In one embodiment, the drive mechanism and the electric motor are enclosed within a common housing. In some embodiments, the pivotal gear is enclosed in the common housing, at least a portion of the swivel shaft extends through the housing, and the pivotal gear is attached to the swivel shaft within the housing.

BRIEF DESCRIPTION OF THE DRAWINGS

FIG. 1 is a top plan view of an overall structure of a small watercraft incorporating a steering system for an outboard motor, in accordance with one embodiment.

FIG. 2 is a partial side elevational view of the small watercraft of FIG. 1.

FIG. 3 is a top plan view of a steering system for an outboard motor, according to one embodiment.

FIG. 4 is a vertical cross sectional view of part of the steering system of FIG. 3.

FIG. 5 is a top plan view of a steering system for an outboard motor according to another embodiment.

FIG. 6 is a vertical cross sectional view of part of the steering system of FIG. 5.

FIG. 7 is a top plan view of a steering system for an outboard motor according to yet another embodiment.

FIG. 8 is a partial perspective view of an overall structure of a small watercraft incorporating a conventional steering system for an outboard motor.

FIG. 9 is a partial side elevational view of the small watercraft of FIG. 8

DETAILED DESCRIPTION OF PREFERRED EMBODIMENTS

With initial reference to FIGS. 1 and 2, a small watercraft incorporating a steering system for an outboard motor in accordance with one embodiment is shown. In this specification, the term "front" means a bow side and the term "rear" means a stern side, both with respect to the watercraft.

In the illustrated embodiment, a swivel bracket 4 is mounted to a transom board 2 of a watercraft hull 1 through a clamping bracket 3. The swivel bracket 4 has a swivel bearing 5 extending vertically relative to the sheet surface of FIG. 1. An outboard motor 6 has a swivel shaft 7 pivotally supported by the swivel bearing 5. The outboard motor 6 integrally includes an outboard motor body 11 having a drive shaft 9 for rotating a screw propeller and an internal combustion engine 10 for driving the drive shaft 9, and the swivel shaft 7.

The illustrated watercraft hull 1 has a steering wheel 12 disposed at a cockpit. A steering control device 14 is placed at a bottom end of a steering shaft 13, which contains a steering wheel operational angle sensor 15 and a reverse torque motor 16. Preferably, the steering control device 14 is connected via a signal cable 17 to a controller 18 on the outboard motor 6. The controller 18 is connected to electric motors 19. The reverse torque motor 16 generates a reaction force corresponding to the external force received from the watercraft hull 1 against the rotational operation by an operator of the watercraft to provide the operator with a steering wheel operating sense when the operator rotates the steering wheel 12.

FIG. 3 is a top plan view showing the major part of the steering system for the outboard motor, constructed and operative in accordance with one embodiment. FIG. 4 is a cross sectional view of the major part.

In FIGS. 3 and 4, the internal combustion engine 10, an engine cowling 20 in which the internal combustion engine 10 is housed and the outboard motor body 11 are omitted.

The swivel bracket 4 is coupled to the clamping bracket 3 at its watercraft hull side end portion, for pivotal movement relative to a tilt member such as a tilt shaft 21. The swivel bracket 4 is formed to extend to the outboard motor body 11. As shown in FIG. 4, the illustrated swivel bracket 4 has a reversed "L" shape, bending downward at a portion on the way to extend. The swivel bracket 4 has the swivel bearing 5 on its rear end. The swivel bearing 5 of the swivel bracket 4 preferably is hollow.

Because the swivel shaft 7 supported by the swivel bearing 5 is fixed to a front end of the outboard motor body 11 via a support bracket 22 (see FIG. 2), the outboard motor 6 is pivotable about the axis of the swivel bearing 5 (i.e., the axis of the swivel shaft 7). In the illustrated embodiment, the swivel shaft 7 extends upward beyond a top end of the swivel bearing 5.

With specific reference to FIGS. 3 and 4, a sector pivotal gear 23 is fixed to the swivel shaft 7 under a condition such that teeth 24 thereof are generally directed forward toward the watercraft hull 1. The electric motors 19 preferably are disposed above the swivel bracket 4, and a worm gear 26 is attached to an output shaft 25 of each electric motor 19. A worm wheel 27 meshing with each worm gear 26 is also disposed above the swivel bracket 4.

In the embodiment depicted in FIGS. 3 and 4, such two electric motors 19 are provided to obtain a large steering force and also to avoid an unsteerable state due to malfunctions. The output shafts 25 of the respective electric motors 19 preferably extend forward and parallel to each other. In this embodiment, a small gear 28 is integrally fixed to a bottom surface of the worm wheel 27. A double staged middle gear unit 29 meshing with the small gear 28 is placed at a center portion of the swivel bracket 4. Accordingly, a rotational speed of the worm wheel 27 is reduced, and the rotational force of the worm wheel 27 is transmitted to the sector pivotal gear 23 from the small gear 28 through the double staged middle gear unit 29.

A protective cover 36 preferably encloses the drive mechanism including the sector pivotal gear 23, the worm gears 26 attached to the respective output shafts 25 of the electric motors 19, the worm wheel 27 meshing with the respective worms gears 26, the small gear 28 fixed to the bottom surface of the worm wheel 27, and the double staged middle gear 29, etc., to prevent water spray from splashing them. In the illustrated embodiment, the swivel shaft 7 supported by the swivel bearing 5 extends upward beyond the top end of the swivel bearing 5 to go through the protective cover 36. Accordingly, the protective cover 36 has a through-hole 37 which the swivel shaft 7 goes through. A seal member 38 closes the gap defined between the swivel shaft 7 and the periphery of the through-hole 37 so that water is blocked from entering the inside of the protective cover 36.

Preferably, an hourglass, or globoid, worm gear preferably is used as the worm gear 26, while an hourglass worm wheel is used as the worm wheel 27. Because of the use of such a combination of the hourglass worm gear and wheel, a number of teeth can simultaneously mesh with each other in comparison with a combination of a cylindrical worm gear and wheel, and also instantaneous contact areas of tooth surfaces are relatively large. The worm gear 26 and the worm wheel 27 not only have enhanced durability but also transmit larger drive force when the outboard motor 6 is pivoted in a horizontal plane about the axis of the swivel shaft 7. It is to be understood that other shapes and configurations of worms gears and worm wheels can be employed.

Alternatively, the worm gear 26 and the worm wheel 27 can be hypoid types. In this construction, the movement can be transmitted from one hypoid gear to the other hypoid gear in skewed relationship between drive and driven shafts of the gears. The output shaft 25 of each electric motor 19, which is the drive shaft of the one hypoid gear, can be offset from the driven shaft of the other hypoid gear. Flexibility in design choices of attaching positions of the electric motor 19 is thus enhanced. The steering system is easily designed, accordingly.

An operation (action) performed by the above-described embodiment will be described next.

In the above embodiment, a motor activating signal initiated by the controller 18 starts the rotation of the electric motors 19 that in turn rotate the worm gear 26 attached to the output shaft 25. The respective worm wheel 27 rotates accordingly. The rotation of the worm wheel 27 is then, through the small gear 28 unitarily coupled with the worm wheel 27, transmitted to an upper gear 30 of the double staged middle gear unit 29. Because a lower gear 31 of the gear unit 29 is unitarily coupled with the upper gear 31, the sector pivotal gear 23 meshing with the lower gear 31 then rotates. Finally, the rotation of the sector pivotal gear 23 rotates the swivel shaft 7 fixed to the sector pivotal gear 23.

Because the swivel shaft 7 is pivotably supported by the swivel bearing 5 of the swivel bracket 4 and is fixed to the outboard motor body 11 by the support bracket 21, rotation of the swivel bracket 7 rotates the outboard motor body 11 in the horizontal plane about the axis of the swivel shaft 7.

In the embodiments described above, the sector pivotal gear 23 attached to the swivel shaft 7, the drive mechanism which includes the respective worms gears 26, the worm wheel 27, the double staged middle gear 29, etc. to drive the sector pivotal gear 23, and the electric motors 19 functioning as the drive power source are all positioned between the swivel bracket 4 and the engine cowling 20. As such, no voluminous components such as the drive mechanism are placed in front of the tilt shaft 21 of the bracket unit within the watercraft. Thus, the drive mechanism and the electric motors 19 positioned between the swivel bracket 4 and the engine cowling 20 do not interfere with the deck 35 or the transom board 2 even when the outboard motor 6 is pivoted in the vertical plane to be tilted up about the tilt shaft 21. A sufficient space thus is ensured for the tilt-up movement so that the tilt up operation can be easily performed. Because the drive mechanism only needs the gear assembly including the worm wheel 27, the double staged middle gear unit 29, and the like to be attached to a predetermined portion of the swivel bracket 4, the bracket unit does not need to have any aperture for attachment, neither does the outboard motor 6 have any steering bracket. The construction thus makes it simpler and more compact to attach the steering system to the watercraft.

FIG. 5 is a top plan view showing a major part of another embodiment of a steering system for the outboard motor. FIG. 6 is a cross sectional view of the major part.

In the embodiment illustrated in FIGS. 5 and 6, the electric motors 19 are disposed above the swivel bracket 4, and a drive mechanism including the worm gear 26 attached to the output shaft 25 of each electric motor 19 and the worm wheel 27 meshing with each worm gear 26 is disposed in a central area of the swivel bracket 4. A small spur gear 32 is unitarily attached to the bottom surface of the worm wheel 27. The sector pivotal gear 23 meshes with the small spur gear 32. Additionally, in this embodiment, the output shafts 25 of the respective electric motors 19 are united to form a single output shaft in order to obtain a large steering force and also to avoid an unsteerable state due to malfunctions.

Other components and operations (action) are the same or similar as those of the embodiment discussed above in connection with FIGS. 3 and 4. Such components are assigned with the same reference numerals and are not described repeatedly.

Operation (action) of the illustrated embodiment will be described next.

The rotation of the electric motor 19 by the motor activating signal from the controller 18 rotates the worm gear 26 attached to the output shaft 25 to rotate the worm wheel 27 meshing with the worm gear 26. With the rotation of the worm wheel 27, the small spur gear 32 unitarily coupled with the worm wheel 27 rotates. The rotational force of the small spur gear 32 is transmitted to the sector pivotal gear 23. The swivel shaft 7 fixed to the sector pivotal gear 23 rotates, accordingly.

As thus discussed, according to this embodiment, the electric motor 19 and the drive mechanism can be compactly placed between the swivel bracket 4 and the engine cowling 20. The steering system with the electric motor 19 for the outboard motor 6 thus can be provided without changing the overall size of the outboard motor 6.

FIG. 7 is a top plan view of another embodiment of a steering device for an outboard motor. In this embodiment, respective output shafts 25 of two electric motors 19 have small bevel gears 33 separately meshing with a large bevel gear 34. In this specification, the term "bevel gear" means a gear having an umbrella shape, including a normally toothed bevel gear having the so-called tooth lines consistent with base lines of its pitch circle, a spiral bevel gear having spiral tooth lines each of which has a certain twist angle, and a spiral bevel gear having spiral tooth lines each of which has no twist angle (zerol bevel gear), and even including a conic gear having spiral teeth for transmitting the movement between skewed axes (hypoid gear).

In the illustrated embodiment, the electric motors 19 are arranged differently than in the embodiments discussed above. Because of using such two electric motors, the steering force generated thereby is larger than that generated by one electric motor 19. Also, in the event of malfunctions of one of the electric motors 19, the other electric motor 19 can still effectively operate to make the steering. Of course, in this and other embodiments only a single electric motor, or more than two such motors, may be employed.

In the illustrated embodiment, the small bevel gears 33 and the large bevel gear 34 are hypoid types. As such, the movement can be transmitted from one hypoid gear to the other hypoid gear in skewed relationship between the drive and driven shafts of the gears. The output shaft 25 of the electric motor 19, which is the drive shaft of the one hypoid gear, can be offset from the driven shaft of the other hypoid gear. That is, differently from a normally toothed bevel gear having the so-called tooth lines consistent with base lines of its pitch circle, or a spiral bevel gear having spiral tooth lines each of which has a certain twist angle, a spiral bevel gear having spiral tooth lines each of which has no twist angle (zerol bevel gear), the drive shafts of the respective small bevel gears 33 and the driven shaft of the large bevel gear 34 do not necessarily cross orthogonally each other. Flexibility in design choices of attaching positions of the electric motor 19 is thus enhanced. The steering system is easily designed, accordingly.

Because other components and operations (action) are the same or similar as those of the first and second embodiments, such components are assigned with the same reference numerals and are not described repeatedly.

Although some of embodiments of the present invention are described above, such embodiments do not restrict the scope of the steering system for an outboard motor according to the principles discussed herein, and instead simply illustrate embodiments demonstrating inventive principles. It is to be understood that outboard motors having other configurations and having differing mounting structures can benefit from aspects disclosed herein.

For example, in the embodiment described above, the swivel bracket 4 has the swivel bearing 5 extending vertically, while the outboard motor 6 has a swivel shaft 7 supported by the swivel bearing 5 for pivotal movement. Alternatively, the swivel bracket 4 can have the swivel shaft 7, and the outboard motor 6 can have the swivel bearing 5 supporting the swivel shaft 7 for pivotal movement.

In such case, the embodiments discussed above in connection with FIGS. 3 and 4 can be modified so that the small gear 28 unitarily coupled with the worm wheel 27 directly meshes with the sector pivotal gear 23. Because no double staged middle gear 29 is used in the modified embodiment, more compact design of the steering system can be realized.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. For example, another mode may include asymmetrical construction such as having one worm gear and one bevel gear combining to drive a spur and/or double stage gear that in term drives the sector pivotal gear. Other combinations, modifications and substitutions are also contemplated. Thus, it is intended that the scope of the present invention herein disclosed should not be limited by the particular disclosed embodiments described above, but should be determined only by a fair reading of the claims that follow.

What is claimed is:

1. A watercraft comprising a transom having an outboard motor mounted thereon through a mount unit having a swivel member and a clamping member, the outboard motor having a cowling and being supported by the swivel member in a manner so that the outboard motor may pivot about a generally vertical axis in a generally horizontal plane, the swivel member attached to the clamping member at a tilt member disposed in a forward portion of the clamping member and configured so that the swivel member pivots about an axis of the tilt member in a generally vertical plane to adjust a tilt angle and a trim angle of the outboard motor, and a steering mechanism comprising a pivotal gear adapted to pivot with the outboard motor, a drive mechanism for driving the pivotal gear, and an electric motor adapted to provide drive force for the drive mechanism, wherein the pivotal gear, drive mechanism and electric motor are disposed between the tilt member and the outboard motor cowling, and wherein the drive mechanism includes a small bevel gear attached to an output shaft of the electric motor and a large bevel gear meshing with the small bevel gear, and the drive mechanism is positioned between a center and a rear end of the swivel bracket.

2. A watercraft according to claim 1 wherein the small bevel gear and the large bevel gear are hypoid types.

3. An outboard motor adapted to be mounted to a transom board of a watercraft through a bracket unit having a swivel bracket and a clamping bracket, the outboard motor having a steering system comprising a swivel shaft disposed in a rear portion of the bracket unit and extending generally vertically, a pivoting mechanism for pivoting the outboard motor about an axis of the swivel shaft in a generally horizontal plane, the swivel bracket of the outboard motor adapted to pivot in a generally vertical plane about a generally horizontal axis of a tilt member disposed in a front portion of the bracket unit so as to adjust a tilt angle and a trim angle of the outboard motor, a pivotal gear attached to the swivel shaft, a drive mechanism driving the pivotal gear, and an electric motor providing drive force to the drive mechanism, wherein the pivotal gear, drive mechanism and electric motor are positioned between the swivel bracket and an engine cowling of the outboard motor, and wherein the drive mechanism includes a small bevel gear attached to an output shaft of the electric motor and a large bevel gear meshing with the small bevel gear, and the drive mechanism is positioned between a center and a rear end of the swivel bracket.

4. An outboard motor according to claim 3 wherein the small bevel gear and the large bevel gear are hypoid types.

5. An outboard motor according to claim 3, wherein the drive mechanism and the electric motor are enclosed within a common housing.

6. An outboard motor according to claim 5, wherein the pivotal gear is enclosed in the common housing, and wherein at least a portion of the swivel shaft extends through the housing, and the pivotal gear is attached to the swivel shaft within the housing.

* * * * *

UNITED STATES PATENT AND TRADEMARK OFFICE

CERTIFICATE OF CORRECTION

PATENT NO. : 7,517,262 B2
APPLICATION NO. : 11/781785
DATED : April 14, 2009
INVENTOR(S) : Makoto Mizutani It is certified that error appears in the above-identified patent and that said Letters Patent is hereby corrected as shown below:

In column 2, approx. line 38, after "worm" please insert --wheel--.

In column 2, approx. line 38, please change "hypoids" to --hypoid--.

In column 4, line 38, please change "worms" to --worm--.

In column 4, line 60, please change "worms" to --worm--.

In column 5, approx. line 27, please change "worms" to --worm--.

In column 8, line 15, in Claim 2 please change "claim 1" to --claim 1,--.

In column 8, line 38, in Claim 4 please change "claim 3" to --claim 3,--.

Signed and Sealed this

Twenty-seventh Day of April, 2010

David J. Kappos

David J. Kappos
*Director of the United States Patent and Trademark Office*